United States Patent [19]

Cole et al.

[11] 4,221,493

[45] Sep. 9, 1980

[54] PEN NIBS

[75] Inventors: William L. Cole, Camberley; Valerie A. Buckle, Slough; Humphrey G. Bowden, Twickenham, all of England

[73] Assignee: Scripto, Inc., Doraville, Ga.

[21] Appl. No.: 938,371

[22] Filed: Aug. 31, 1978

[51] Int. Cl.[3] ..... B43K 5/00

[52] U.S. Cl. ..... 401/199

[58] Field of Search ..... 401/196, 198, 199, 207

[56] References Cited

U.S. PATENT DOCUMENTS

| | | | |
|---|---|---|---|
| 3,203,025 | 8/1965 | Schreur | 401/198 X |
| 3,510,227 | 5/1970 | Horie | 401/199 |
| 3,544,229 | 12/1970 | Aoki et al. | 401/199 |
| 3,586,454 | 6/1971 | Funahashi et al. | 401/198 |
| 3,604,817 | 9/1971 | Funahashi et al. | 401/199 |
| 3,628,876 | 12/1971 | Casey et al. | 401/198 |
| 3,864,183 | 2/1975 | Hori | 401/198 X |
| 3,881,828 | 5/1975 | Jones | 401/198 X |
| 4,119,756 | 10/1978 | Midorikawa | 401/198 X |

FOREIGN PATENT DOCUMENTS

| | | | |
|---|---|---|---|
| 1298908 | 7/1969 | Fed. Rep. of Germany | 401/198 |
| 2241581 | 3/1973 | Fed. Rep. of Germany | 401/198 |
| 2547000 | 10/1975 | Fed. Rep. of Germany | 401/199 |

*Primary Examiner*—Eugene H. Eickholt

*Attorney, Agent, or Firm*—Newton, Hopkins & Ormsby

[57] ABSTRACT

A porous pen nib comprising a plastics sheath and a fibrous core, preferably of textile yarn, has a writing tip formed by the rim of the mouth of the sheath and a protruding core center which both wear smoothly and equally in writing use.

5 Claims, 5 Drawing Figures

PEN NIBS

Figure 1:
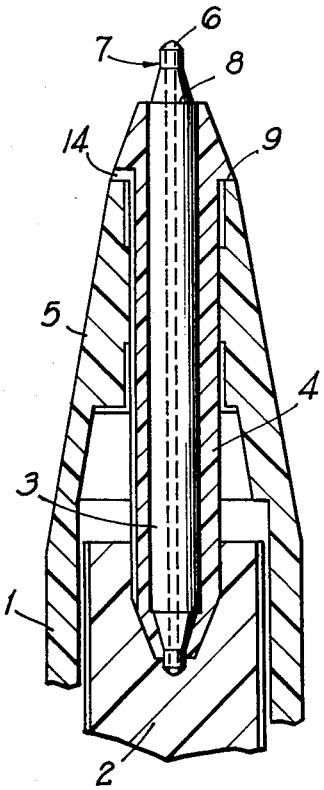

This invention relates to pen nibs of the kind in which a fibrous or other porous writing tip feeds ink to and contacts the writing surface. The term "writing" includes drawing or other marking and "ink" includes any suitable liquid.

Pens with such nibs so far available, popularly called fibre pens, are useful for bold work, making broad traces, but for writing, fine drawing, or other work requiring thin lines, it is difficult to provide a porous writing tip which does not bend, flatten or otherwise undesirably deform under writing pressure.

A porous nib offers the advantage of copious ink flow, so that intense or dense lines can be drawn, but tip deformation can spoil line width, especially the consistent production of lines of less than about 0.7 mm.

Loads exerted on writing tips are surprisingly high, simple measurement showing that people writing apply loads of up to 500 gms, or even more. Due to spread of ink on or in a writing surface, a writing tip contact width must be less than a required line width so that, for example, to give a line width of 0.5 mm under a 500 gms load a writing tip must have a contact width of less than 0.5 mm and can thus apply a pressure of more than 2 Kg per $mm^2$ (20 $MN/m^2$).

Under such a load, known fine fibrous tips soon suffer permanent deformation which spoils them for writing and even porous plastics tips deform sufficiently to spoil line width. The porous structure of a plastics material tip reduces its effective strength substantially below its bulk strength and the load on a writing tip has a considerable lateral component which may be destructive of the cell walls of a porous tip. Consequently even the stronger plastics materials, such as Nylon 66 with a bulk strength of 8 Kg. per $mm^2$ (80 $MN/m^2$) and P.V.F. with a bulk strength of 13 Kg. per $mm^2$ (130 $MN/m^2$), are not strong enough in porous tip form to withstand a writing load of 500 gms exerted on a tip having a contact width of less than 0.5 mm to give a line of that width.

It has already been proposed to provide a nib comprising a thin-walled open-ended tube of seamless plastics material having a rounded end, to provide a smooth surface to contact a writing surface as a writing tip at a conventional writing angle, and being charged with a core, of twisted or untwisted nylon yarn filaments drawn through the tube, providing capillary passages and protruding from the tube so as to feed ink on to a writing surface.

The present invention also arises from the concept of a nib comprising a tubular sheath with a porous core, the sheath providing a strong nib which will not undesirably deform under writing load, will present a writing tip which will not exceed a given writing contact width and can be fed with ink through the porous core which is relieved of any excessive writing load.

So far as is known, such nibs with tubular writing tip sheaths and porous cores are not commercially available and in fact they present two major difficulties. The first is manufacture, it not being practicable to draw a yarn core through a plastics tube for production of nibs on a commercial scale, and the second is the effect of wear in use. The prior proposal referred to above envisages the tube having a "wearing characteristic" greater than that of the core filaments and recites the tube as "extremely long wearing and highly effective in protecting and prolonging the service life of the core filling". It can be shown that these considerations are not well based.

The present invention provides new features which are essential for the satisfactory production of a porous pen nib comprising a tubular sheath of plastics material and a porous core, the sheath being rigid enough to withstand writing load, the rim of the mouth of the sheath at one end forming a firm annular boundary of a writing tip and the porous core presenting a protruding centre of the writing tip.

According to the invention, the plastics sheath and core are locked against relative movement, preferably by penetration of the material of the sheath into interstices of the core, and the materials of the sheath and core are selected to wear smoothly at given rates in use and the areas which they present at the writing tip are designed, with regard to their respective wear rates, to achieve substantially equal recession of the sheath and of the core by wear in use.

In contradistinction to the prior proposal therefore the present invention provides a nib with a sheath intended to wear appreciably in use. The reason for this is that, by the nature of the porous structure of the core presenting less mass to contact the writing surface and its location in the area of substantially continuous contact, as compared with the solid structure and changing peripheral contact of the rim of the sheath mouth in change of orientation of the nib in writing, the rate of recession through wear of the core will be higher than the recession rate of the sheath unless the sheath is designed to wear so as to balance wear of the core.

In order to avoid wear reducing protrusion of the core to the extent that it no longer effectively contacts the writing surface, the sheath must be designed to recede through wear at substantially the same rate as the core. This can be achieved by selection of the core and sheath materials, their proportional dimensions and the design of the writing tip profile of the nib.

Control of relative wear characteristics of the core and sheath cannot alone ensure satisfactory results and it is essential to avoid any displacement of the core in the sheath under writing load. The invention provides for this preferably by penetration of the material of the sheath into interstices of the core, so that they lock together, and this can be done by moulding the sheath on to the core. Other means of locking the core and sheath together, such as by resin bonding, are not excluded.

It is possible to form nibs by injection-moulding of sheaths on to cores but preferably the moulding is extrusion moulding of sheath material on to continuous core material to form continuous rod stock material from which nibs can be made by cutting and grinding to length and shape.

An advantageous step in the extrusion moulding process is rapid quenching by leading the extrudate directly into a water bath on emergence from the die, this step stabilizing the form of the sheath material and establishing the porosity of the core material.

A suitable core material is a bulked continuous filament textile yarn, for example of Nylon 66, 1100–2600 dtex with filaments of 2–20 dtex, preferably with minimum twist and not bonded although bonding, such as by coating with resin, is permissible provided that it does not preclude penetration of the sheath material into interstices of the yarn. The use of staple yarn is not precluded.

For a fine writing nib, with a diameter of not more than 1.3 mm, the core diameter should be not more than 0.8 mm, preferably 0.5 to 0.7 mm.

A suitable sheath material is a high strength plastics material, for example an acetal copolymer (Hostaform-Trade Mark), with a wear rate high enough to achieve wear balance with a nylon core. The compressive strength should be greater than a yield value of 5 $Kg/mm^2$ (50 $MN/m^2$), preferably over 15 $Kg/mm^2$ (100–150 $MN/m^2$), and the compressive modulus 30–3000 $Kg/mm^2$ (300–30000 $MN/m^2$), preferably of the order of 100–1000 $Kg/mm^2$ (1000–10000 $MN/m^2$). The modulus should not be so high that the tip becomes scratchy in use.

For a fine writing nib, the sheath wall thickness at the tip should be 0.15–0.25 mm for a core of the dimensions given above.

To achieve the desired balance of wear, the following equation should be satisfied:

$$\frac{\text{Wear rate of core material}}{\text{Cross-sectional area of core}} = \frac{\text{Wear rate of sheath material}}{\text{Cross-sectional area of sheath}}$$

The wear rate can be measured by testing samples in a writing machine under standard conditions.

The profile of the writing tip should be conical with the rim of the mouth of the sheath rounded, the apical protrusion of the core being about ⅓ core diameter. A preferred profile for a fine writing nib is a rounded core of about 105° apex angle $\phi$ and a radius, in axial section, of about 1.2 times the core diameter for the rounded rim of the mouth of the sheath.

Figure 3:
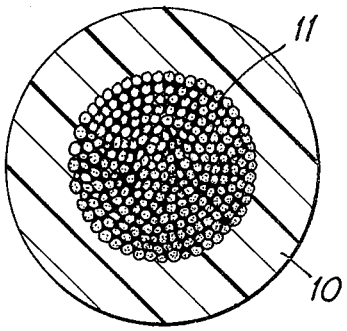
Figure 2:
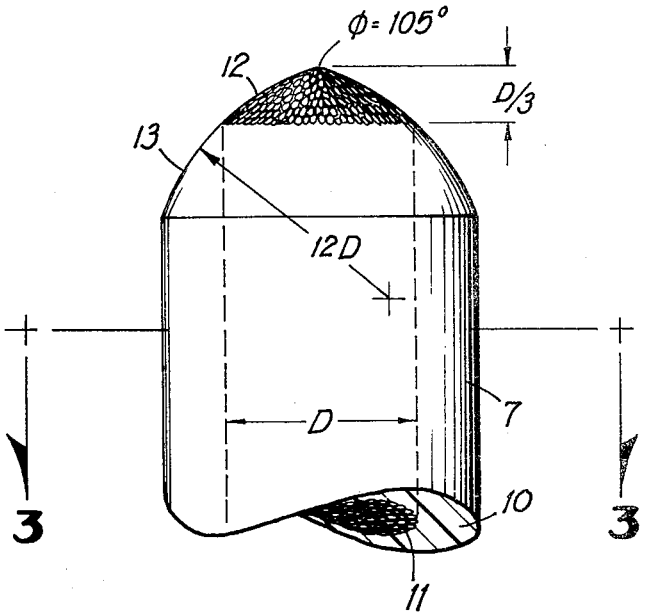
Figure 4:
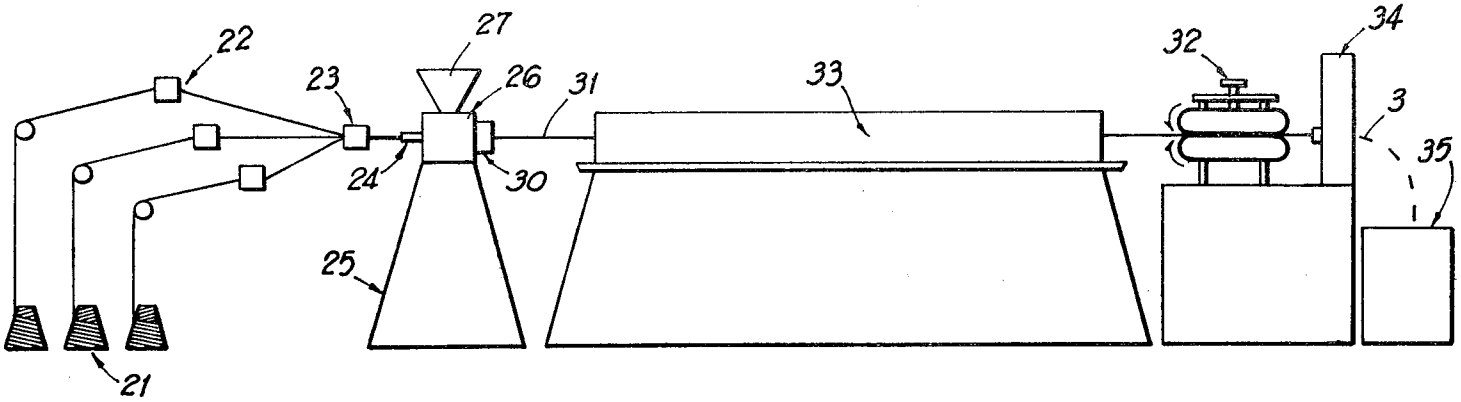
Figure 5:
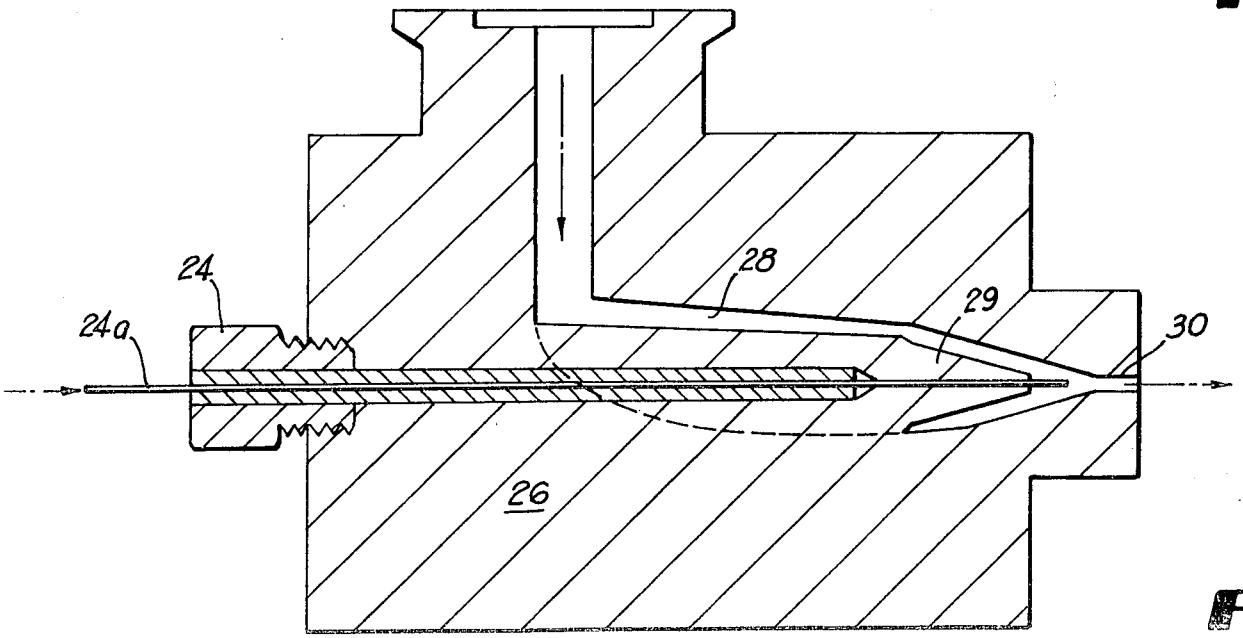

Other features of the invention are included in the following description of a preferred example of a pen nib, and its manufacture, illustrated by the accompanying drawings, in which:

FIG. 1 is a large scale axial section of the writing end of a pen with a nib of the present invention shown in elevation, FIG. 2 is a very much enlarged fragmentary elevation of the writing tip of the nib, FIG. 3 is a cross-section on the line III—III of FIG. 2, FIG. 4 is a schematic elevation of extrusion moulding equipment for nib rod stock and FIG. 5 is a larger scale sectional elevation of the cross-head and die of FIG. 4.

The pen illustrated by FIG. 1 comprises a moulded plastics barrel 1 housing an ink-charged capillary cartridge reservoir 2 into which penetrates the inner end of a nib 3 held in a moulded plastics sleeve 4 which is a friction-tight insertion fit in the tapered nose 5 of the pen barrel. The nib 3 is symmetrically shaped at its ends to provide a writing tip 6, neck 7 and shoulder 8 so that it can be inserted, either end first, into the holding sleeve 4 in the convergent inner end of which it abuts, by the respective shoulder 8, to withstand the reaction of writing pressure. For the same purpose the holding sleeve 4 is shouldered at 9 in extension of the taper of the nose 5 against which it abuts. In accordance with good pen design, the taper of the nose and the projection of the writing tip from the sleeve afford the writer a view of the writing tip.

The nib 3 consists of a tubular plastics sheath 10 which has been extrusion-moulded on to a textile yarn core 11 and ground to shape at each end to provide the writing tip 6, neck 7 and shoulder 8.

The core 11 provides a multiplicity of capillary pores between its yarn filaments to conduct ink from the reservoir 2 and deposit it on a writing surface contacted by the protruding tip 12 of the core and the rim 13 of the mouth of the sheath 10, the core tip 12 and sheath rim 13 together constituting the writing tip. An air admission passage 14 is provided between the nib-holding sleeve 4 and nose 5 to compensate for ink extraction from the reservoir.

The profile of the writing tip is shown by FIG. 2 with the preferred proportions of an apical angle $\phi = 105°$, a core protrusion of about ⅓ of the core diameter D and a radius of the sheath rim of 1.2D.

As can be seen in FIG. 3, the material of the sheath 10 penetrates the interstices between the outer filaments of the yarn core 11 and thus the sheath and core are locked together against relative movement under the loads applied in tip formation, insertion in a pen and use in writing.

The sheath is moulded on to the core by extrusion moulding in equipment such as is illustrated in FIGS. 4 and 5.

As many ends of multiple continuous filament bulked fibre yarn, for example Nylon 66, as are required to make up a required core diameter are drawn from cones 21, through tensioners 22 and a guide bush 23, to pass through a guide tube 24 leading into an extruding machine 25 of the crosshead type which receives in the crosshead 26 hot fluid plastics sheath material, for example an acetal copolymer, from an extruder 27 feeding into an annular passage 28 around a nozzle 29 through which the combined yarn core material 11 enters the die 30 as a mandrel on to which the fluid plastics material is moulded by the die to form the sheath 10 of nib rod stock material 31. The guide tube has a longitudinally adjustable liner 24*a*.

From the die 30, the stock material is drawn, by an endless belt hauler 32, through a water bath 33 in which the extruded sheath 10 is quenched so as to stabilize the form of the sheath material and establish the porosity of the core.

The effect of such quenching is to set the sheath material at its outer surface and cause the core to dilate, after radial compression in the die, so as to have the required level of porosity.

Beyond the hauler 32, the stock 31 passes into a chopper 34 which cuts the stock into nib-lengths 3 which are collected in a receiver 35 for subsequent grinding, in a hopper-fed machine, to form at both ends of each nib the tip 6, neck 7 and shoulder 8 described above.

An important practical feature of the invention is that the sheath material can be applied in such thickness as to enable the nib shape to be made to suit assembly in a pen. In particular, the symmetrical shouldered end shape, as described and illustrated, lends itself to centreless grinding of both ends simultaneously and facilitates pen assembly because the nib does not require preferential insertion of one end. Either end of the nib will write or penetrate the reservoir cartridge and staking, or other special securing means, is not required.

We claim:

1. A porous pen nib comprising a tubular sheath of an acetal copolymer and a porous core of bondable bulked continuous filaments, the sheath being rigid enough to withstand writing load, the rim of the mouth of the sheath at one end forming a firm annular boundary of a writing tip, the porous core presenting a protruding centre of the writing tip, the plastics sheath and the core being locked together against relative longitudinal displacement under writing load by penetration of the acetal polymer of the sheath into interstices of the core, the materials of the sheath and core wearing smoothly at given rates in writing use and the areas of the sheath and core presented at the writing tip being respectively such as to achieve substantially equal recession of the sheath and of the core by wear in writing use.

2. A pen nib according to claim 1, in which the continuous filaments are made of textile yarn.

3. A pen nib according to claim 2 in which the yarn is of nylon with a wear rate high enough to achieve balance with the tubular sheath.

4. A pen nib according to claim 1, in which the writing tip is conical in shape with the rim of the mouth of the sheath at the writing tip being rounded, the apical protrusion of the core being ⅓ core diameter, also rounded and having an apex angle of 105° and a radius in axial section of 1.2 times the core diameter for the rounded rim of the mouth of the sheath.

5. A porous pen nib comprising a tubular sheath of acetal copolymer and a porous core of bulked continuous filament yarn of Nylon 66, 1100–2600 dtex with filaments of 2–20 dtex, the sheath being rigid enough to withstand writing load, the rim of the mouth of the sheath at one end forming a firm annular boundary of a writing tip, the sheath further being not more than 1.3 mm in diameter with a compressive strength greater than a yield value of 5 $Kg/mm^2$ and a compressive modulus of 100–1000 $Kg/mm^2$, the porous core presenting a protruding centre of the writing tip having a diameter not more than 0.8 mm, the plastics sheath and the core being locked together against relative longitudinal displacement under writing load by penetration of the acetal polymer of the sheath into the interstices of the core, the materials of the sheath and core wearing smoothly at given rates in writing use and the areas of the sheath and core presented at the writing tip being respectively such as to achieve substantially equal recession of the sheath and of the core by wear in writing use.

* * * * *